US006749458B1

(12) United States Patent
Kuo et al.

(10) Patent No.: US 6,749,458 B1
(45) Date of Patent: Jun. 15, 2004

(54) CABLE END CONNECTOR ASSEMBLY HAVING PULL MEMBER

(75) Inventors: Chin Pao Kuo, Tu-chen (TW); Yun Long Ke, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/633,193

(22) Filed: Jul. 31, 2003

(30) Foreign Application Priority Data

May 28, 2003 (TW) ..... 92209834 U

(51) Int. Cl.[7] ..... H01R 13/00
(52) U.S. Cl. ..... 439/484; 439/579; 439/499
(58) Field of Search ..... 439/484, 579, 439/695, 660, 595, 260, 497, 608, 499, 498, 330, 331, 73, 610

(56) References Cited

U.S. PATENT DOCUMENTS 4,379,608 A * 4/1983 Olsson et al. ..... 439/329
5,085,596 A * 2/1992 Bowen et al. ..... 439/497
5,387,124 A * 2/1995 Shinohara et al. ..... 439/497
5,871,369 A * 2/1999 Obayashi et al. ..... 439/495
5,980,308 A * 11/1999 Hu et al. ..... 439/497
6,015,310 A * 1/2000 Tojo ..... 439/260
6,099,346 A * 8/2000 Hashiguchi et al. ..... 439/495
6,139,363 A * 10/2000 Ko et al. ..... 439/579
6,183,281 B1 * 2/2001 Wu et al. ..... 439/260
D444,130 S 6/2001 Hayashi et al.
6,273,753 B1 8/2001 Ko
6,305,978 B1 10/2001 Ko et al.
6,338,652 B1 1/2002 Ko

* cited by examiner

*Primary Examiner*—Gary Paumen
*Assistant Examiner*—Edwin A. León
(74) *Attorney, Agent, or Firm*—Wei Te Chung

(57) ABSTRACT

A cable end connector assembly (1) includes an insulative housing (2), a number of cantacts (24) a shell (3), a pair of latches (5), a pull member (52) and a cable (4). The insulative housing has two opposite side walls (23). The contacts are received in the insulative housing. The shell encloses the insulative housing. The latches are pivotally assembled to the shell and located adjacent to the respective side walls of the insulative housing, and each latch has a claw section (5111) at a front end thereof and an inclined section (5132) obliquely extending from the claw section. The pull member includes a pull portion (523) and a pair of abutting sections (5221) extending from opposite sides of the pull portion and movably abutting against corresponding inclined sections of the latches as the pull portion being pulled. The cable includes a number of wires (41) connected with the corresponding contacts.

1 Claim, 7 Drawing Sheets

CABLE END CONNECTOR ASSEMBLY HAVING PULL MEMBER

BACKGROUND OF THE INVENTION

1. Field of the Invention

The present invention relates to a cable end connector assembly, and particularly to a micro coaxial cable end connector assembly having a pull member to facilitate disengaging the cable end connector assembly from a mating complementary connector.

2. Description of Related Art

U.S. Pat. Nos. 6,305,978 B1, 6,273,753 B1, 6,338,652 B1 and D444,130 S disclose low profile micro coaxial cable end connector assemblies. This type connector assembly is used to transmit signals between a mother board in a base of a note book computer and an LCD panel of the note book computer. The micro coaxial cable end connector assembly must securely engage with a complementary connector mounted on back of the LCD panel, because the LCD panel is frequently pivoted relative to the base of the note book computer. The micro coaxial cable end connector assembly conventionally has no locking device for latching with the complementary connector when the two connectors are connected together. This can not ensure a reliably secure connection between the two connectors, whereby the connector assembly may be unintentionally disconnected from the complementary connector, and the signal transmission between the two connectors is broken.

Co-pending U.S. patent application Ser. No. 10/199713, assigned to the same assignee as this application and filed on Jul. 19, 2002, discloses a micro coaxial cable end connector assembly providing a pair of latch devices. The latch devices are pivotally assembled to opposite sides of a housing of the connector assembly and each has a claw at a front end thereof for latching with a complementary connector. When the connector assembly engages with the complementary connector, the claws of the latch devices extend into the complementary connector and latch therewith, whereby the two connectors are securely connected together. To separate the connector assembly from the complementary connector, rear ends of the latch devices are pushed toward each other by fingers of a user to cause the claws to be pivoted away from each other, whereby latch of the two connectors is released and the connector assembly can be pulled to separate from the complementary connector.

However, the micro coaxial cable end connector assembly sometimes nearly clings to the back of the LCD panel when it is in a mated condition, and when the connector assembly is low profiled, it is quite difficult for the user to push rear ends of the latch devices and pull the connector assembly out of the complementary connector. Furthermore, much more troubles will be encountered in the separating operation of the two connectors if the complementary connector is surrounded by many other electronic components.

Hence, an improved micro coaxial cable end connector assembly is required to overcome the disadvantages of the prior art.

SUMMARY OF THE INVENTION

A major object of the present invention is to provide a cable end connector assembly, which has a pull member to facilitate disengaging the cable end connector assembly from a mating complementary connector.

In order to achieve the object set forth, a cable end connector assembly comprises an insulative housing, a plurality of contacts, a shell, a pair of latches, a pull member, and a cable. The insulative housing has two opposite side walls. The contacts are received in the insulative housing. The shell encloses the insulative housing. The latches are pivotally assembled to the shell and located adjacent to the respective side walls of the insulative housing, and each latch has a claw section at a front end thereof and an inclined section obliquely extending from the claw section. The pull member comprises a pull portion and a pair of abutting sections extending from opposite sides of the pull portion and movably abutting against corresponding inclined sections of the latches as the pull portion being pulled. The cable comprises a plurality of wires connected with the corresponding contacts.

Other objects, advantages and novel features of the invention will become more apparent from the following detailed description when taken in conjunction with the accompanying drawings.

DETAILED DESCRIPTION OF THE INVENTION

Figure 1:
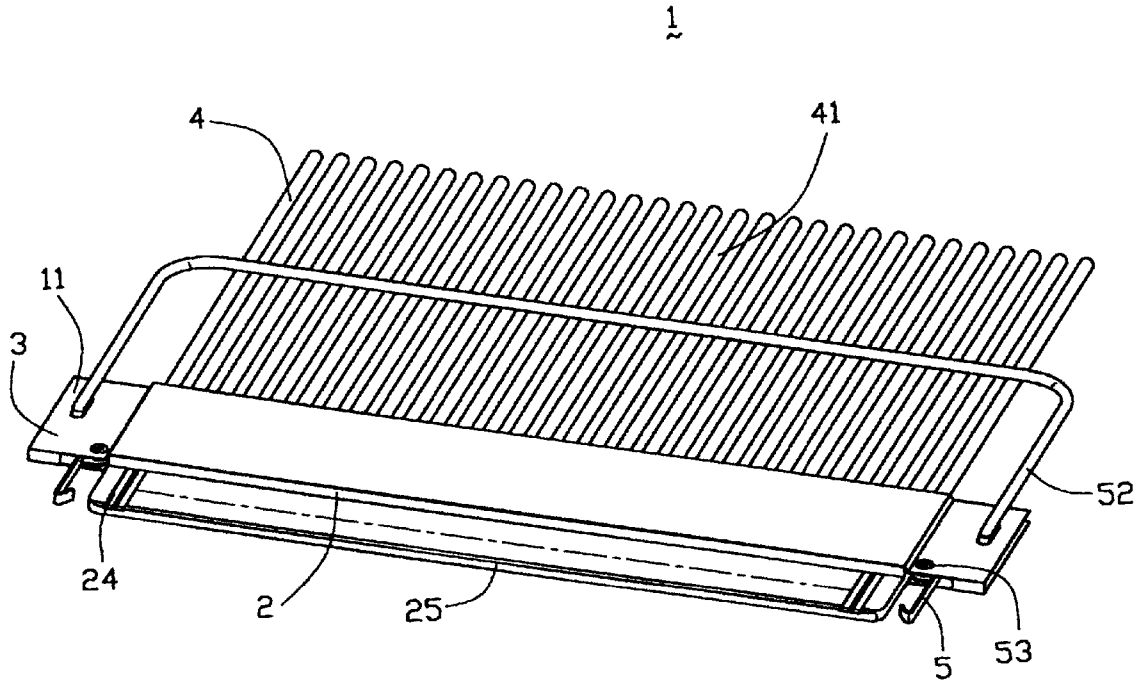
FIG. 1 is a perspective view of a cable end connector assembly in accordance with the present invention.
Figure 2:
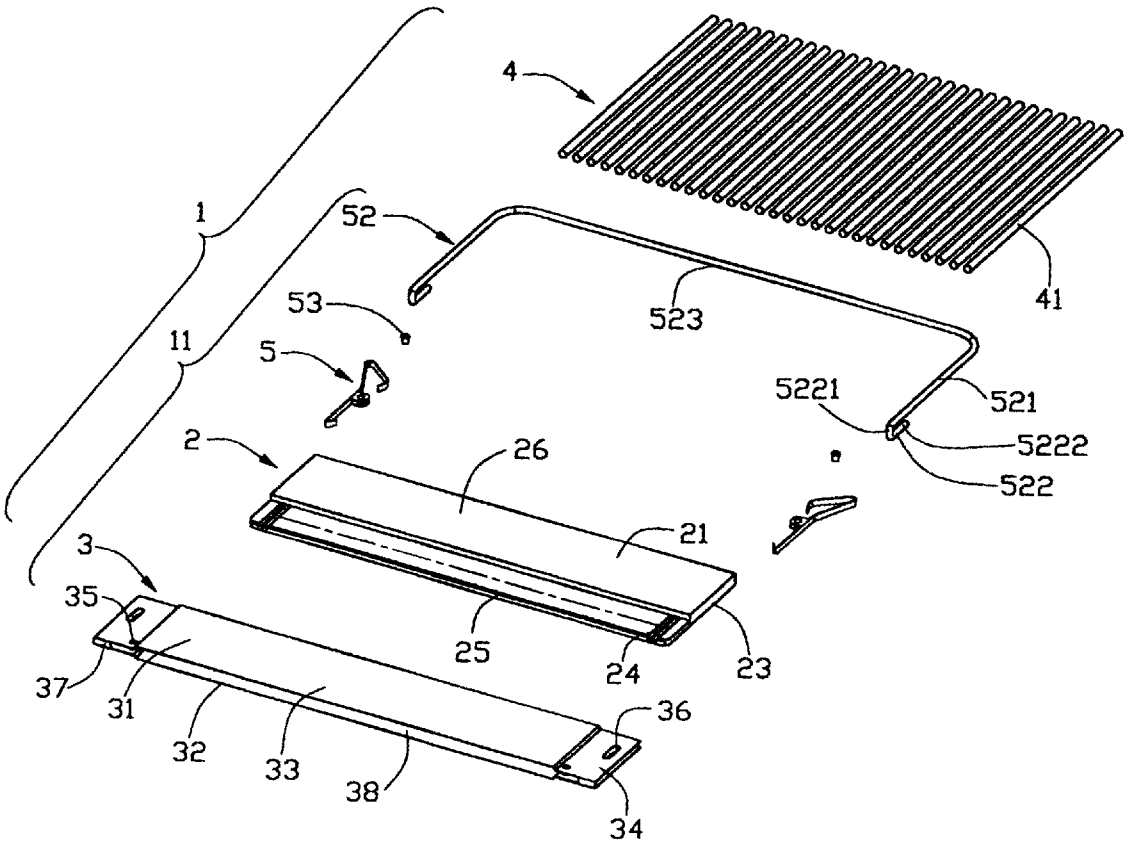
FIG. 2 is a partially exploded perspective view of the cable end connector assembly of FIG 1.
Figure 3:
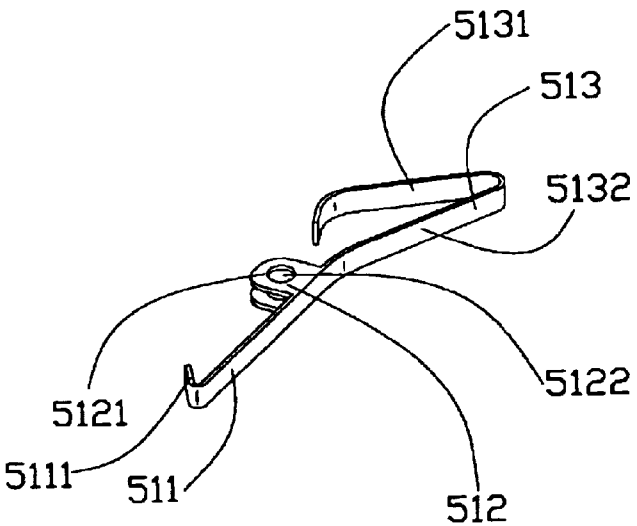
FIG. 3 is a perspective view of a latch of the cable end connector assembly of FIG. 2.
Figure 4:
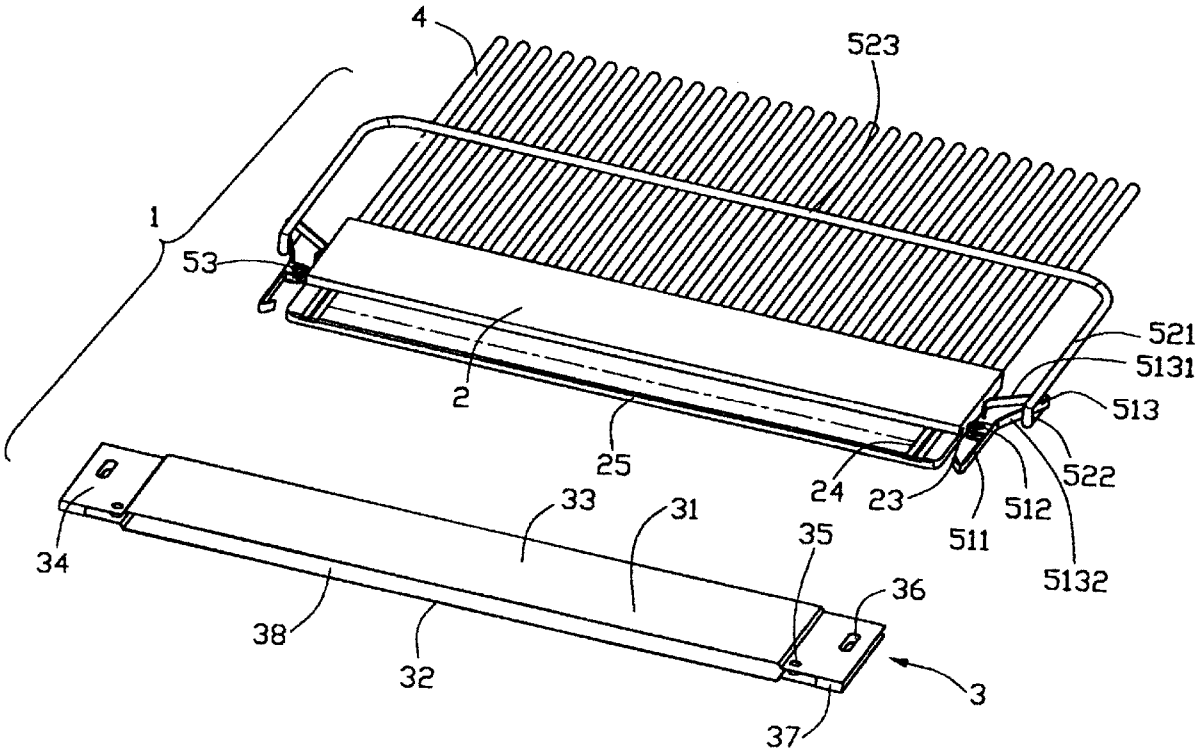
FIG. 4 is a partially exploded perspective view of the cable end connector assembly of FIG. 1.

Referring to FIGS. 1 to 5, a cable end connector assembly 1 in accordance with the present invention includes a cable end connector 11 and a cable 4.

The cable end connector 11 includes an elongated thin insulative housing 2, a plurality of contacts 24, a shell 3, a pair of latch devices, and a pull member 52.

The insulative housing 2 includes an elongated base portion 26 and a tongue portion 25 extending forwardly from the base portion 26. The insulative housing 2 has a top wall 21, a bottom wall 22 and a pair of side walls 23 connecting the top and bottom walls 21, 22.

The contacts 24 are retained in the base portion 26 and exposed in the tongue portion 25.

The cable 4 includes a plurality of wires 41. Each wire 41 electrically connects to the respective contact 24 at a rear portion (not labeled) of the base portion 26.

The shell 3 has an upper plate 31, a lower plate 32, a pair of connecting portions 37 connecting upper and lower plates 31, 32, and a receiving space 38 defined between the upper and lower plates 31, 32 for receiving the base portion 26 of the insulative housing 2 therein. Each plate 31 (32) includes an elongated main portion 33 and a pair of side portions 34 respectively sidewardly extending from opposite sides of the main portion 33. Each side portion 34 defines an aperture 35 at a front portion thereof adjacent to the main portion 33 and a slot 36 adjacent a rear portion thereof away from the main portion 33. The slot 36 extends along a direction substantially perpendicular to an elongated direction of the main portion 33.

Each latch device comprises a latch 5 and a pivot 53. Each latch 5 is received between the two opposite side portions 34 of respective upper and lower plates 31, 32 and comprises an engaging portion 511, a retaining portion 512, and a resilient portion 513. The engaging portion 511 is formed with a claw section 5111 at a front end thereof exposed out of the shell 3 for latching with a complementary connector (not shown). The retaining portion 512 comprises a pair of top and bottom plates 5121 respectively sidewardly extending from top and bottom edges of a rear of the engaging portion 511. Each plate 5121 defines a retaining hole 5122 therein aligned with the apertures 35 of the corresponding opposite side portions 34. The resilient portion 513 comprises an inclined section 5132 extending obliquely and rearwardly from the engaging portion 511 and away from the corresponding side wall 23 of the insulative housing 2, and a spring tab 5131 turn reversely form the inclined section 5132 and then extending forwardly to be abuttable with the side wall 23. The pivot 53 extends through the corresponding retaining holes 5122 of the latch 5 and apertures 35 of the shell 3 to pivotally connect the latch and the shell together.

The pull member 52 comprises a pull portion 523, a pair of arm portion 521 perpendicularly extending from opposite sides of the pull portion 523, and a pair of driving portions 522 bending from the corresponding arm portions 521. Each driving portion 522 comprises an abutting section 5221 perpendicularly bending from the arm portion 521 and a limiting section 5222 further perpendicularly bending from the abutting section 5221. A plane where the driving portion 522 lies is formed at an angle with respect to a plane where the pull portion 523 and the arm portion 521 lie, preferably, such angle is a right angle as shown in this embodiment. The driving portion 522 extends through two opposite slots 36 of the respective upper and lower plates 31, 32 with the abutting section 5221 vertically received in the slots 36 and area between the slots for abutting against the inclined section 5132 of the latch 5 and the limiting section 5222 together with the arm portion 521 sandwiching the inclined section 5132 therebetween.

Figure 5:
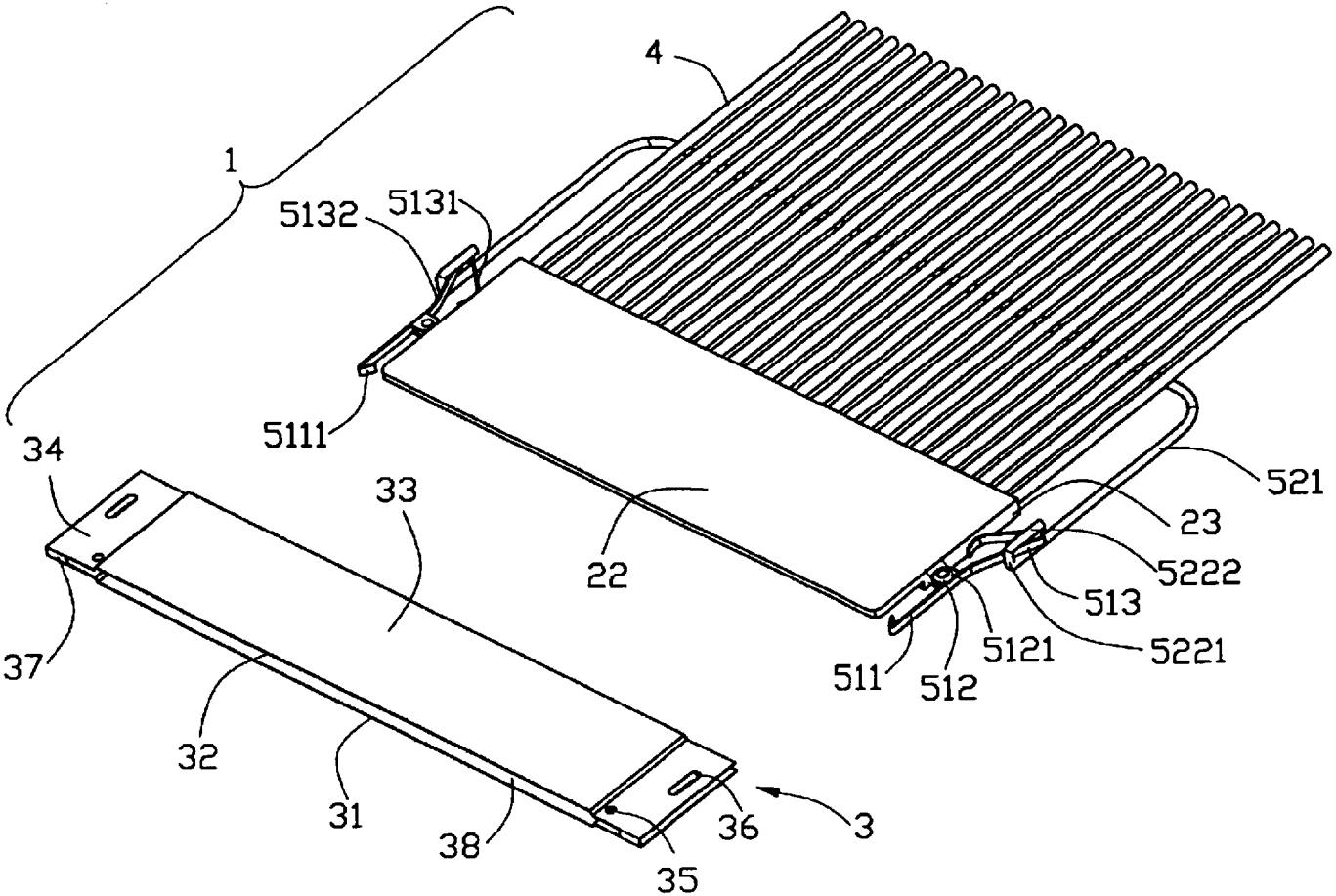
FIG. 5 is a view similar to FIG. 4, but taken from a different aspect.
Figure 6:
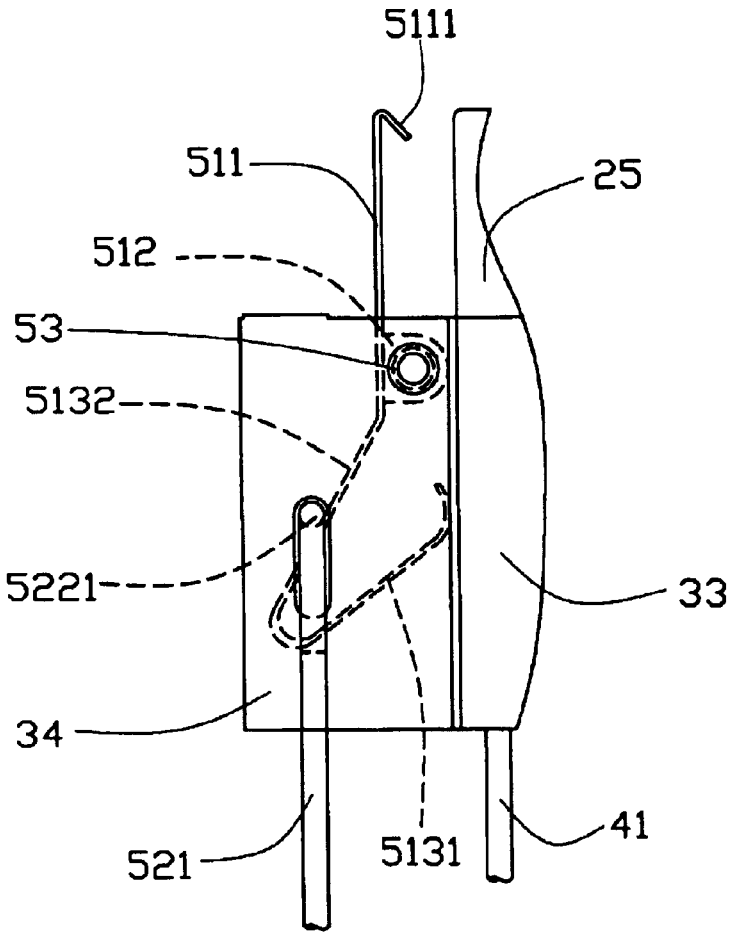
FIG. 6 is a top sketch view of the cable end connector assembly of FIG. 1, showing a latch of the cable end connector assembly is in a latching condition.
Figure 7:
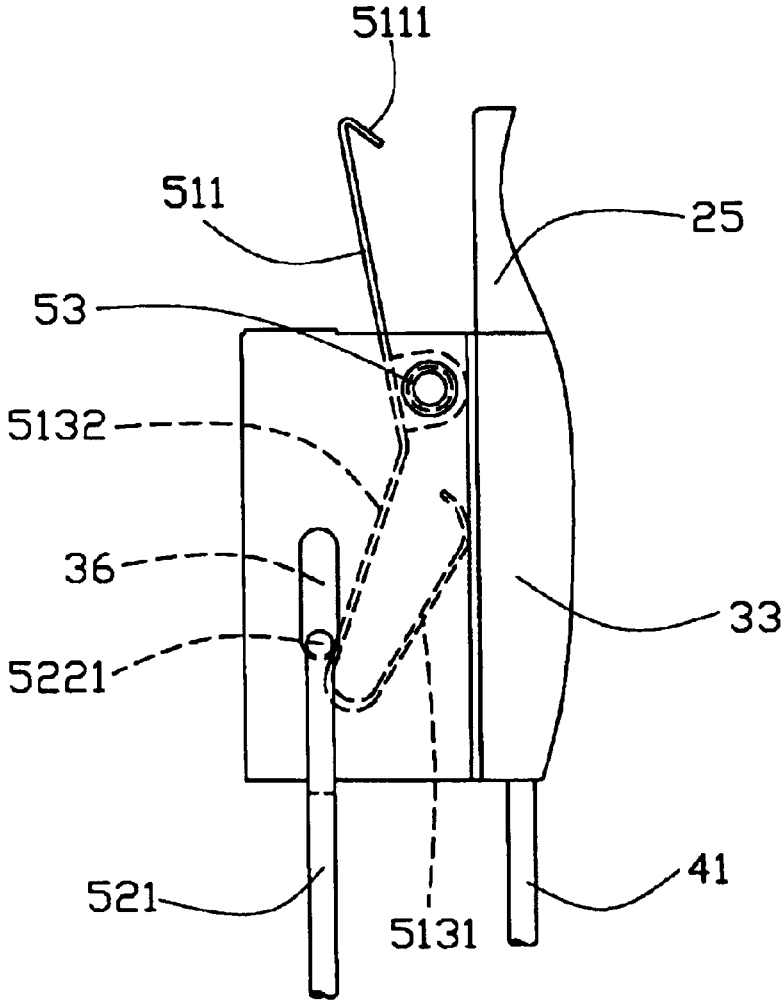
FIG. 7 is a view similar to FIG. 6, showing the latch is in an unlatching condition.

When the cable end connector assembly 1 engages with the complementary connector, the claw sections 5111 extend into the complementary connector to latch therewith, and the spring tab 5131 presses the side wall 23 of the insulative housing 2 to ensure the claw section securely retained therein. Referring to FIG. 5, at this time, the abutting section 5221 is located at a front end of the corresponding slot 36 of the shell 3. To separate the connector assembly I from the complementary connector, the pull portion 523 of the pull member 52 is pulled rearwardly, and the abutting section 5221 of the driving portion 522 is driven to move along the slots 36. During the period, the inclined sections 5132 of the driving portions of the latches are pressed by the abutting section 5221 toward each other to cause the claw sections 5111 of the engaging portions 511 to be pivoted away from each other. Referring to FIG. 6, when the abutting section 5221 moves to a rear end of the slot 36, the claw section 5111 is far away from the side wall 23, at this time, the latch between the connector assembly 1 and the complementary connector has been released, and then the connector assembly 1 can be pulled to separate from the complementary connector. By this structure, the operation of separating the cable end connector assembly from a complementary connector is simple and readily, especially, which does not have to be applied directly to the latch 5.

In alternative embodiments, the latch device may be assembled to the insulative housing instead of the shell as shown in the above embodiment. Such modification is obvious to persons skilled in the art, for instance, a pair of projections are sidewardly projected from the opposite side walls of the insulative housing each with a through aperture therein, and the pivot extends through the holes of the retaining portion of the latch and the aperture to pivotally connect the insulative housing and the latch. By such structure, the cable end connector assembly can get the same effects as obtained by the above embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly comprising:

a cable end connector comprising a thin insulative housing, a plurality of contacts received in the insulative housing, a latch beside the insulative housing and comprising an engaging portion and a resilient portion connecting with the engaging portion, and a pull member comprising a driving portion engageable with the resilient portion of the latch and a pull portion connecting with the driving portion, the driving portion being moveable by the pull portion to deform and move the resilient portion toward the insulative housing thereby moving the engaging portion; and a cable comprising a plurality of wires connected with the corresponding contacts, a shell having an elongated main portion covering the insulative housing and a side portion extending sidewardly from the main portion, a pivot, and wherein the latch comprises a retaining portion extending from the engaging portion thereof, the pivot extending through the side portion of the shell and the retaining portion of the latch to pivotally connect the latch and the shell, the shell comprises an upper plate, a lower plate and a connecting portion connecting the upper and lower plates, and wherein the insulative housing and the latch are both sandwiched between the upper and lower plates, the resilient portion of the latch comprises an inclined section obliquely extending from the engaging portion and away from the insulative housing, and a spring tab bearing against the insulative housing, the driving portion of the pull member has an abutting section abuttable with the inclined section of the resilient portion, the pull member comprises an arm portion between the pull portion and the driving portion, and wherein the driving portion comprises a limiting section bending from the abutting section and, together with a section of the arm portion, sandwiching the inclined section of the latch therebetween, a plane where the driving portion lies is oriented at an angle with respect to a plane where the pull portion and the arm portion lie, the side portion of the shell defines a slot therein, and wherein the abutting section is movably received in the slot, the slot extends along a direction substantially perpendicular to an elongated direction of the shell, the engaging portion is formed with a claw section at a front end thereof for latching with a mating connector, the insulative housing comprises a base portion and a tongue portion extending from the base portion, and wherein the contacts are retained in the base portion and exposed in the tongue portion, a pivot, and wherein the insulative housing comprises a projection formed from a side thereof, and wherein the latch comprises a retaining portion extending from the engaging portion thereof, the pivot extending through the retaining portion of the latch and the projection of the insulative housing to pivotally connect the latch and the shell.

* * * * *